US006164099A

United States Patent [19]

Sh

[11] Patent Number: 6,164,099

[45] Date of Patent: Dec. 26, 2000

[54] DOOR LOCK

[76] Inventor: Ching-He Sh, No. 399, Chung-Hua Rd., Hualien City, Hualien Hsien, Taiwan

[21] Appl. No.: 09/422,266

[22] Filed: Oct. 21, 1999

[51] Int. Cl.[7] ..... E05B 65/06

[52] U.S. Cl. ..... 70/134; 70/224; 292/337; 292/348; 292/357; 292/336.3

[58] Field of Search ..... 70/134, 149, 144, 70/221–224; 292/1.5, 336.3, 337, 348, 353, 357

[56] References Cited

U.S. PATENT DOCUMENTS

| | | | |
|---|---|---|---|
| 4,876,866 | 10/1989 | Fleming et al. | 70/134 X |
| 5,150,592 | 9/1992 | Lin | 70/224 X |
| 5,176,416 | 1/1993 | Lin | 292/143 |
| 5,211,432 | 5/1993 | Lin | 292/337 X |
| 5,390,517 | 2/1995 | Yamada | 70/224 X |
| 5,516,160 | 5/1996 | Kajuch | 292/337 X |
| 5,540,070 | 7/1996 | Adelmeyer | 292/337 X |
| 5,611,581 | 3/1997 | Ghostley | 292/337 X |
| 5,613,715 | 3/1997 | Kim | 292/337 X |
| 5,765,412 | 6/1998 | Koskela et al. | 70/134 |
| 5,904,232 | 5/1999 | Shen | 70/224 X |
| 5,927,770 | 7/1999 | Huang | 292/337 X |
| 6,014,878 | 1/2000 | Shen | 70/224 X |
| 6,029,484 | 2/2000 | Jetton | 70/224 X |

*Primary Examiner*—Suzanne Dino Barrett
*Attorney, Agent, or Firm*—Birch, Stewart, Kolasch & Birch, LLP

[57] ABSTRACT

An auxiliary door lock in which a spring is coupled between a coupling block, which moves a latch bolt, and a left side board to push the coupling block and the latch bolt forwards when the door lock is unlocked and the key is removed from the door lock; the door handle is locked to stop the door lock from unlocking with the key when pressing a button on the door handle after the door handle has been turned to a vertical position, and unlocked when pressing the button again.

1 Claim, 10 Drawing Sheets

DOOR LOCK

BACKGROUND OF THE INVENTION

The present invention relates to a door lock, which automatically forces the latch bolt forwards after unlocking, and automatically locks the door after closing of the door.

FIG. 1 shows a door lock according to U.S. Pat. No. #5,176,416 (issued on Jan. 5, 1993). According to this structure of door lock, the latch bolt is at the unlocking status when the door lock is unlocked. When returned the home and opened the door, the door lock must be locked again after closing of the door. If the door lock is not locked after closing of the door, an intruder can directly open the door and enter the house.

SUMMARY OF THE INVENTION

The present invention eliminates the aforesaid problem. According to the present invention, the door lock comprises a casing, a latch bolt moved in and out of the casing, a left side board and a right side board connected in parallel, a coupling block spaced between the left side board and the right side board, the coupling block having a front end coupled to the latch bolt and a rear end formed with a coupling groove, a cam coupled between the left side board and the right side board, the cam comprising a center shaft, an axially extended cross hole on the center shaft of the cam, and a pin coupled to the coupling groove on the coupling block, an indoor lock assembly, the indoor lock assembly comprising a rose and a door handle, the door handle comprising a shaft and a rectangular hole on the shaft, the rose comprising a center through hole, which receives the shaft of the door handle, and a lock cylinder having a spindle inserted through the cross hole on the center shaft of the cam and engaged into the rectangular hole on the shaft of the door handle, wherein a spring is coupled between a locating rod at the coupling block and a rod at the left side board to push the coupling block and the latch bolt forwards when the lock cylinder is unlocked and the key is removed from the lock cylinder; the rose of the indoor lock assembly comprises two grooves arranged at right angles, and a latch and a spring mounted in the grooves inside the center through hole on the rose; the door handle comprises a spring and a lock pin mounted on the inside and acted relative to the latch to lock/unlock the indoor lock assembly.

DETAILED DESCRIPTION OF THE PREFERRED EMBODIMENT

Figure 1:
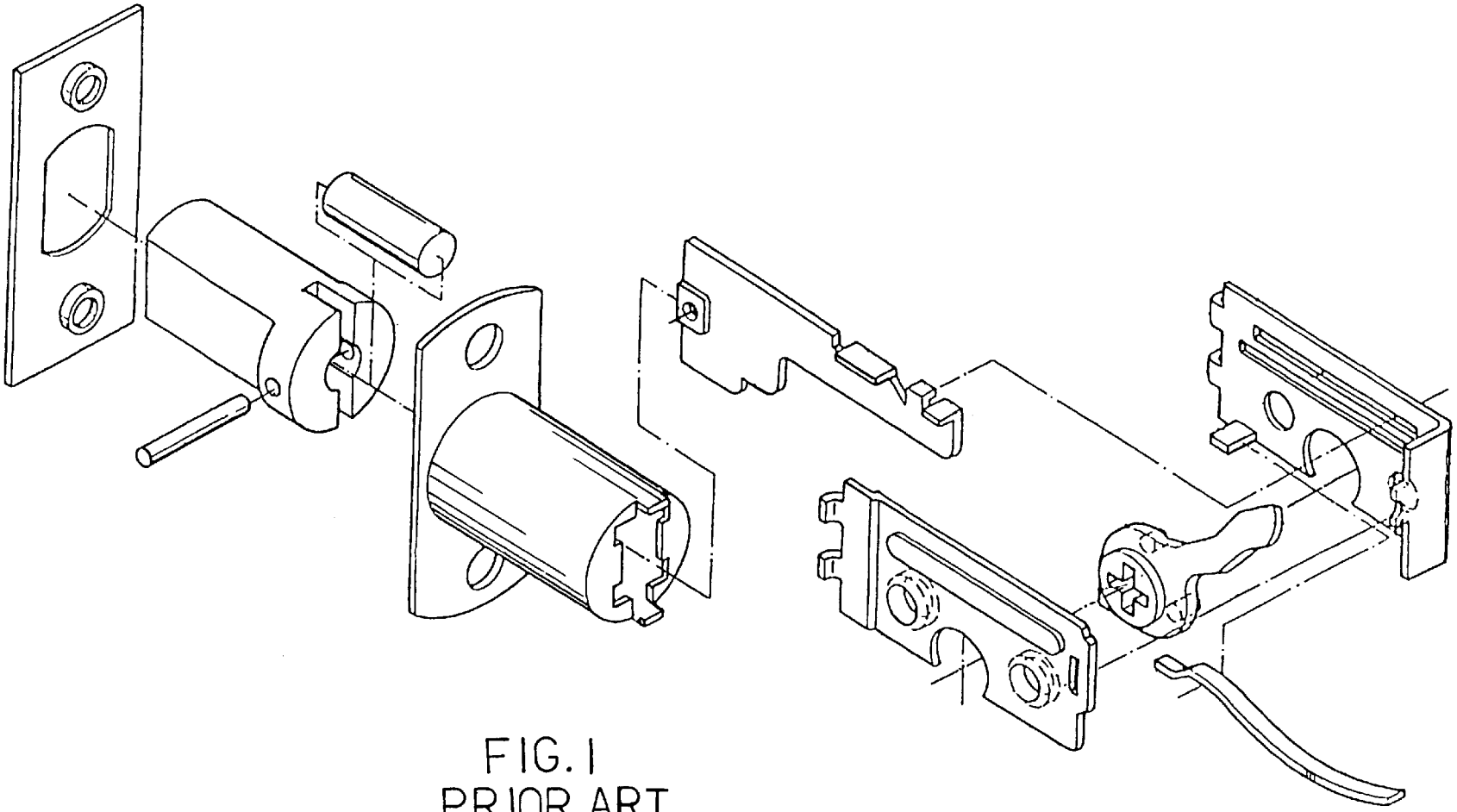
FIG. 1 PRIOR ART
FIG. 1 is an exploded view of a door lock according to U.S. Pat. No. #5,176,416.
Figure 2:
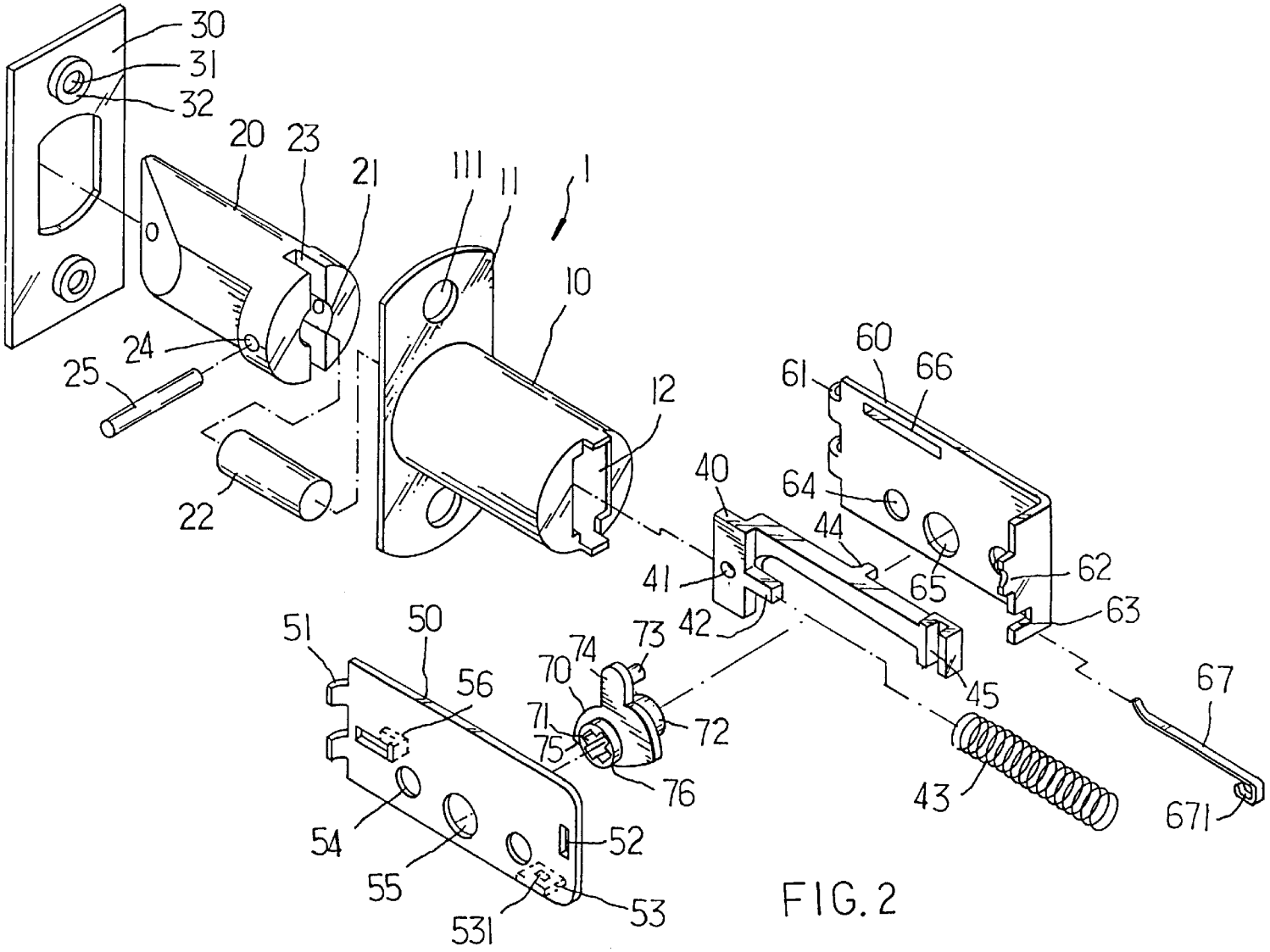
FIG. 2 is an exploded view of an auxiliary door lock for a door lock according to the present invention.
Figure 3:
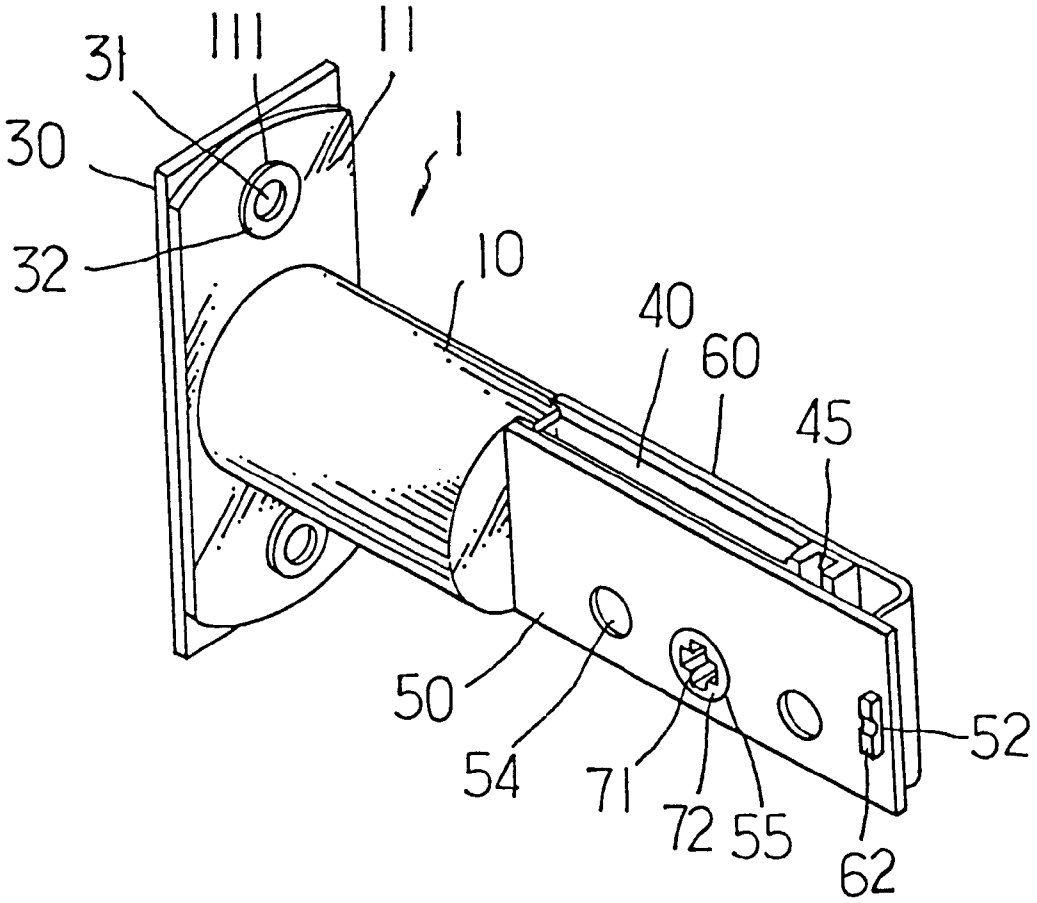
FIG. 3 is an assembly view of FIG. 2.
Figures 4, 5:
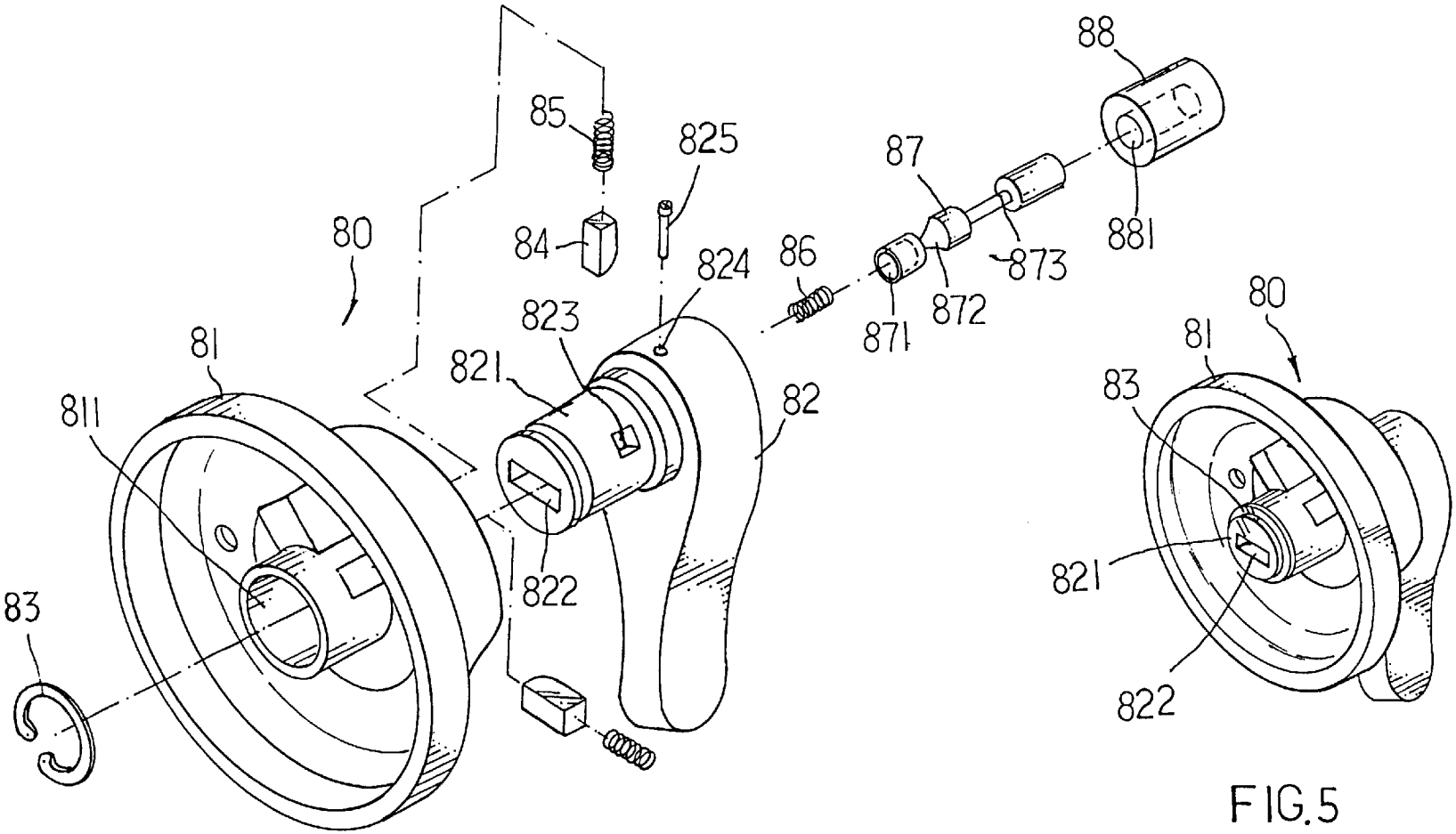
FIG. 4 is an exploded view of the indoor lock assembly for the door lock according to the present invention.
FIG. 5 is an assembly view of FIG. 4.
Figure 6:
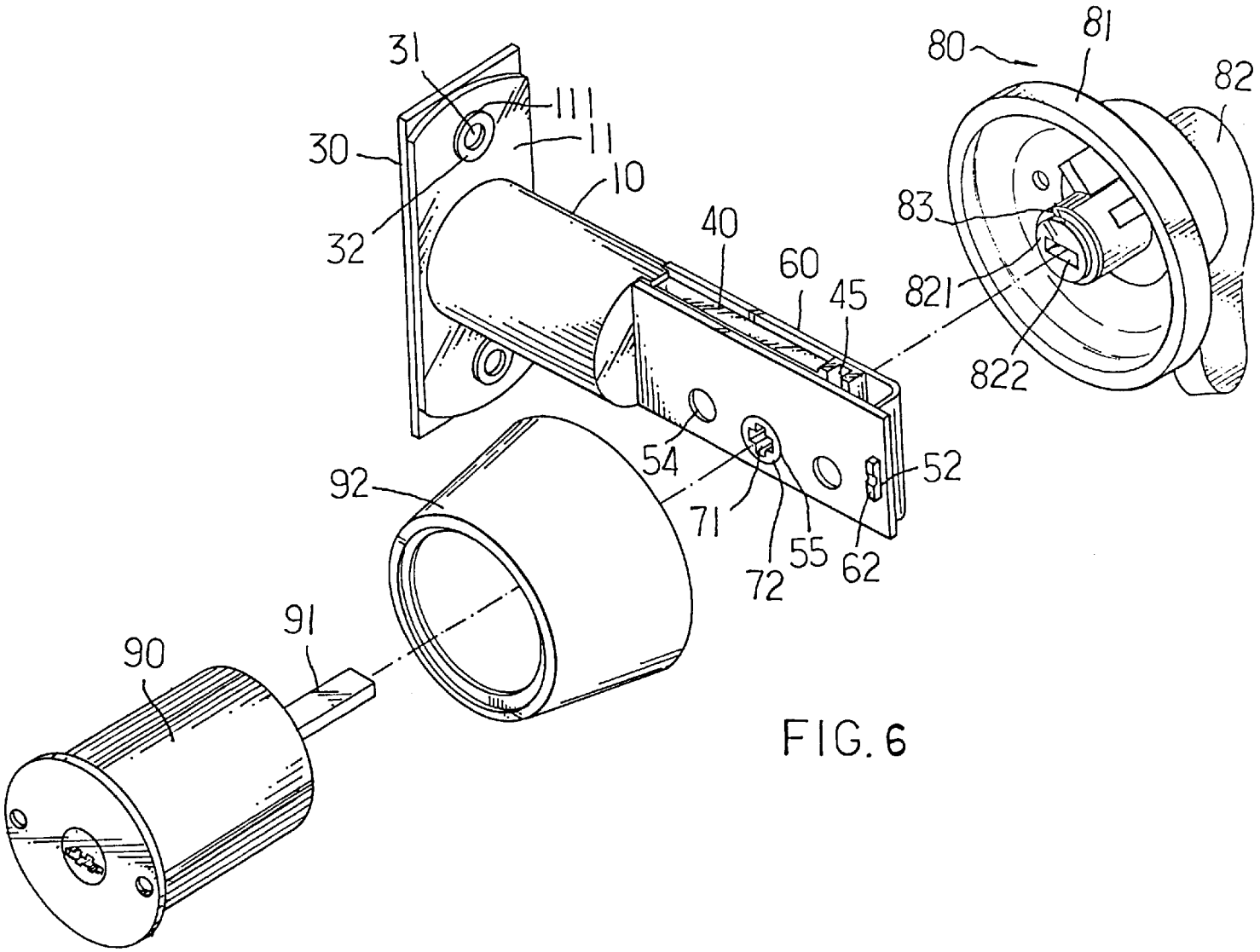
FIG. 6 shows the relative positioning of the indoor lock assembly and the lock cylinder of the auxiliary door lock according to the present invention.
Figure 7:
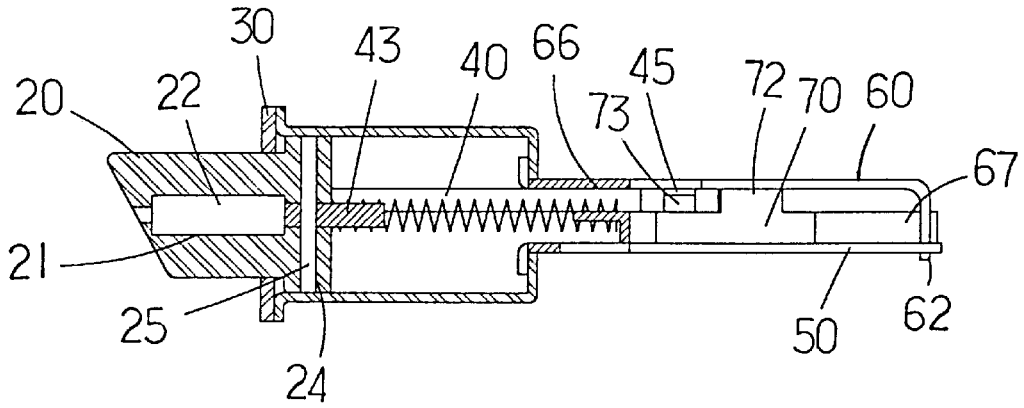
FIG. 7 is a sectional view of the auxiliary door lock according the present invention.

Referring to FIGS. 2 and 3, the present invention comprises an auxiliary door lock 1, an indoor lock assembly 80, and a lock cylinder 90. The auxiliary door lock 1 comprises a casing 10, a latch bolt 20, a faceplate 30, a coupling block 40, a left sideboard 50, a right side board 60, and a cam 70.

The casing 10 comprises a front mounting wall 11, two mounting holes 111 respectively provided at the front mounting wall 11 near its two distal ends, and a rear opening 12 at the rear end thereof.

The latch bolt 20 is mounted in the casing 10, comprising a rear center hole 21 at the center of the rear end thereof, which receives a round rod 22, a coupling notch 23 at the rear end for receiving one end of an elongated coupling block 40, and a transverse pin hole 24 near the rear end, which receives a pin 25.

The face plate 30 comprises two through holes 31 corresponding to the mounting holes 111 at the front mounting wall 11 of the casing 10, and two annular flanges 32 raised from one side wall thereof around the through holes 31 and respectively fitted into the mounting holes 111 at the front mounting wall 10 of the casing 10.

The elongated coupling block 40 is inserted through the rear opening 12 at the casing 10 and coupled to the latch bolt 20, comprising a front coupling hole 41 transversely disposed in the front end thereof and coupled to the pin 25 in the transverse pin hole 24 at the casing 20, a locating rod 42 extended backwards from the front end and holding a compression spring 43, a guide rod 44 perpendicularly raised from one side wall thereof on the middle and moved with the coupling block 40 in a longitudinal sliding slot 66 on a right side board 60, and a rear coupling groove 45 near a rear end thereof for coupling to a pin 73 at a cam 70 for enabling the latch bolt 20 and the coupling block 40 to be moved with the cam 70;

The left side board 50 and the right side board 60 are arranged in parallel and at two opposite sides of the coupling block 40, each comprising at last one, for example, two front hooks 51 or 61 respectively hooked in the rear opening 12 in the rear end of the casing 10, two longitudinally spaced first round holes 54 or 64, and a second round hole 55 or 65 spaced between the first round holes 54 or 64. The left side board 50 further comprises a plug hole 52 near the rear end thereof, a lug 53 with a notch 531 raised from the right side wall thereof adjacent to the plug hole 52, and an angled rod 56 raised from the right side wall and aimed at the locating rod 42 at the coupling block 40 to hold the other end of the compression spring 43. The right side board 60 further comprises a rear plug rod 62 plugged into the plug hole 52 on the left side board 50, a rear notch 63 below the plug rod 62, and a longitudinal sliding slot 66 longitudinally disposed adjacent to the top side edge thereof and coupled to the guide rod 44 at the coupling block 40.

The cam 70 is coupled between the left side board 50 and the right side board 60, comprising a center shaft 72 inserted with its two distal ends into the second round hole 55 on the left side board 50 and the second round hole 65 on the right side board 60, a cross hole 71 axially extended through the shaft 72, a lug 74 raised from the periphery, and a pin 73 perpendicularly raised from the lug 74 and engaged into the coupling groove 45 at the coupling block 40.

The indoor lock assembly 80 comprises a rose 81, and a door handle 82. Referring to FIGS. 4, 5, 9 and 11, the rose 81 comprises a center through hole 811, two grooves 812 arranged at right angles inside the center through hole 811, and a latch 84 and a spring 85 mounted in the grooves 812 inside the center through hole 811. The door handle 82 comprises a shaft 821 perpendicularly raised from the front end thereof and inserted through the center through hole 811 on the rose 81 and secured thereto by a clamp 83, a rectangular hole 822 axially formed on the shaft 821 for receiving the spindle 91 of the lock cylinder 90, a rectangular hole 823 formed on the periphery of the shaft 821 corresponding to the grooves 812 for receiving the latch 84, a screw hole 824 at the front end, a screw 825 fastened to the screw hole 824, an axial hole 826 which receives a spring 86 and a lock pin 87, and a back hole 827, which receives a button 88. The lock pin 87 comprises a front recessed hole 871, which receives one end of the spring 86, a first neck 872, and a second neck 873. The button 88 has an axial hole 881, which receives the rear end of the lock pin 87.

Figure 8:
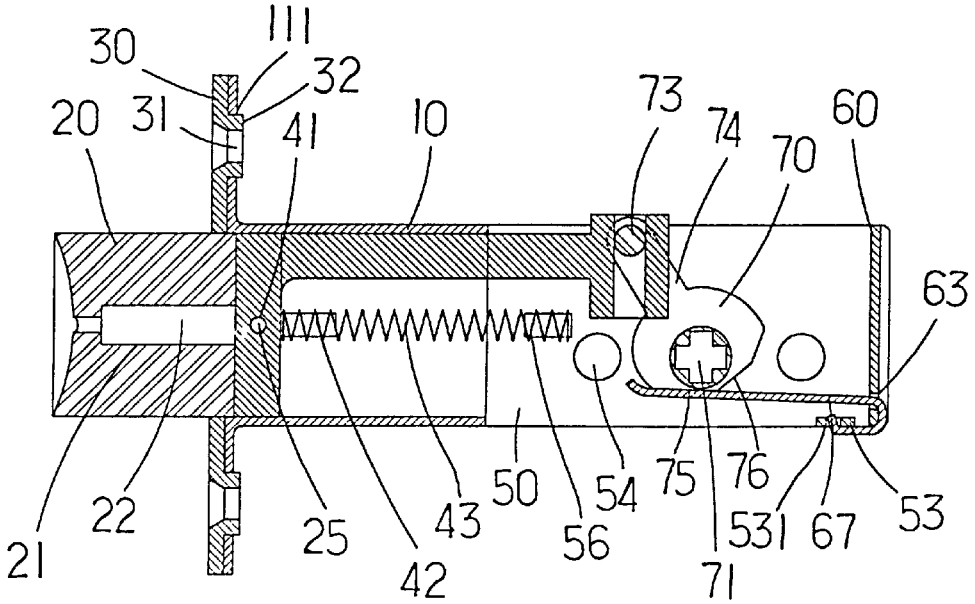
FIG. 8 is a sectional view of a part of the present invention, showing the auxiliary door lock locked.
Figure 9:
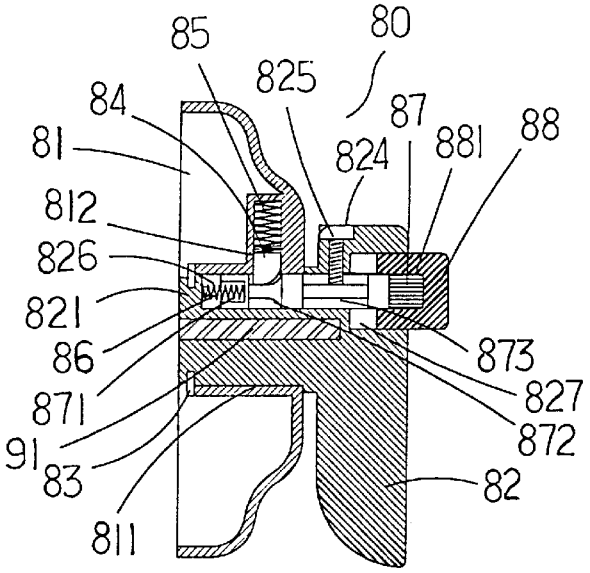
FIG. 9 is a sectional view of a part of the present invention, showing the indoor lock assembly locked.
Figure 10:
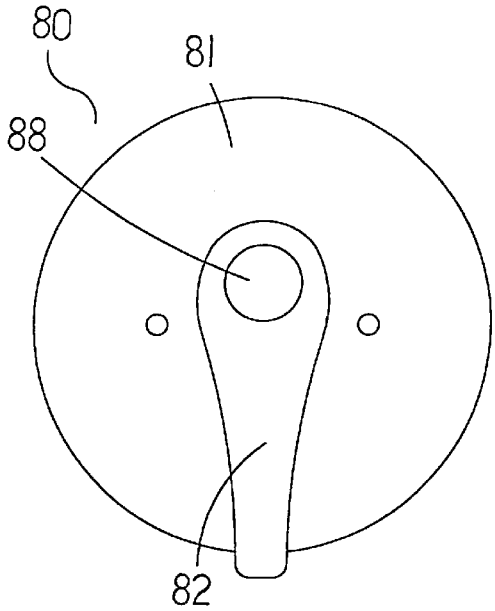
FIG. 10 is a side view of FIG. 9.
Figure 11:
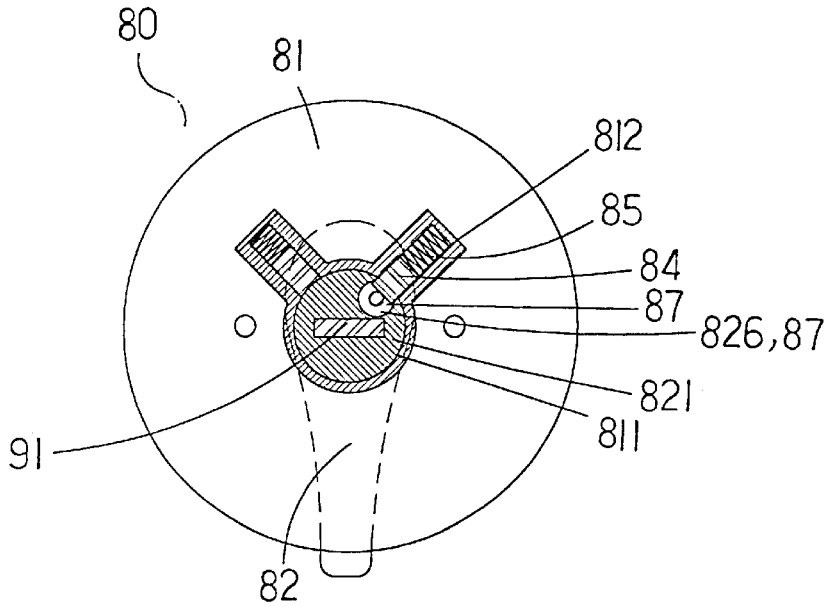
FIG. 11 is a schematic drawing showing the operation of the indoor lock assembly according to the present invention.
Figure 12:
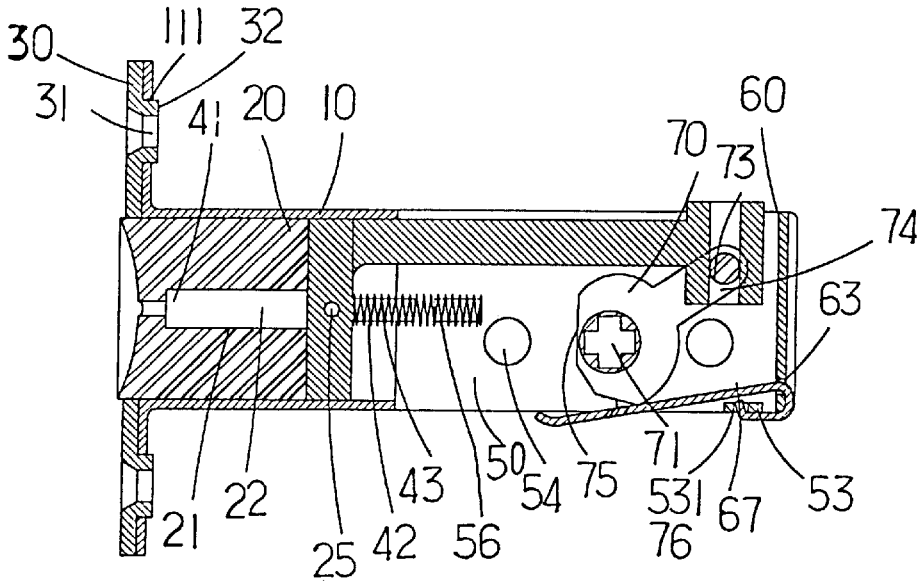
FIG. 12 is a sectional view of a part of the present invention, showing the auxiliary door lock unlocked.
Figure 13:
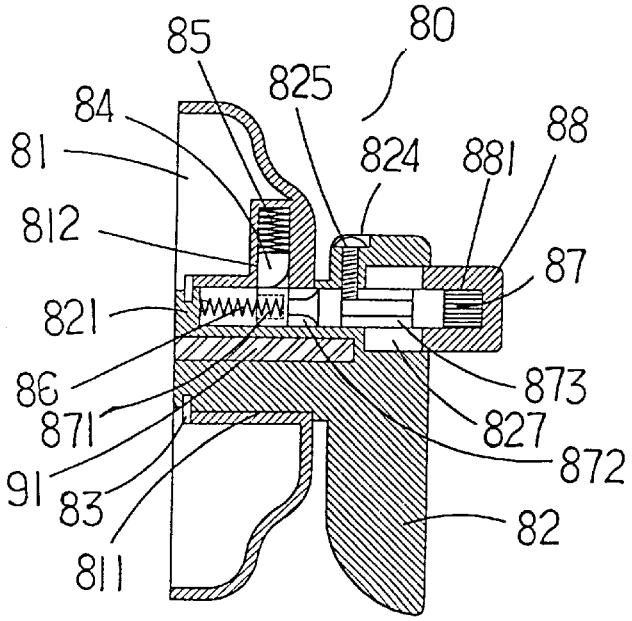
FIG. 13 is a sectional view of a part of the present invention, showing the indoor lock assembly unlocked.
Figure 14:
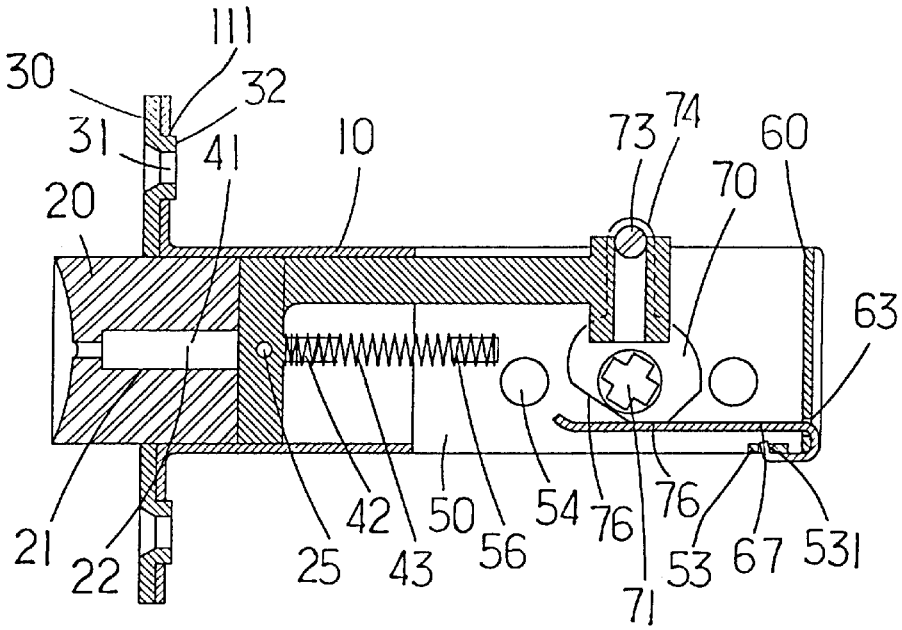
FIG. 14 is a sectional view of a part of the present invention, showing the status of the auxiliary door lock after unlocking of the lock cylinder and removal of the key from the lock cylinder.
Figure 15:
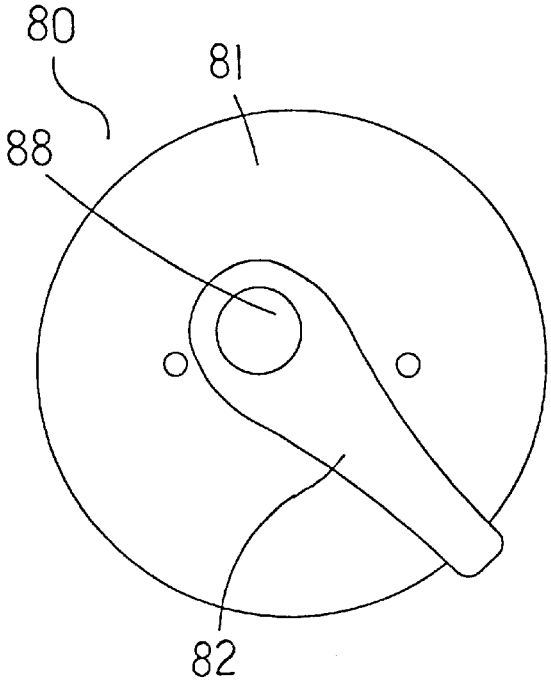
FIG. 15 is a front view of the indoor lock assembly after unlocking of the lock cylinder and removal of the key from the lock cylinder.
Figure 16:
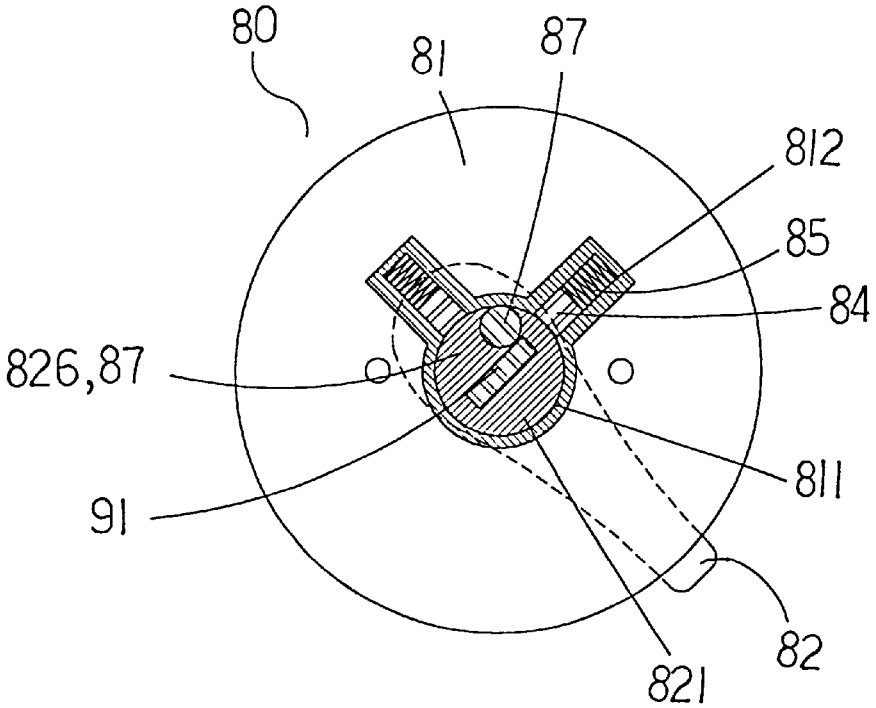
FIG. 16 is a schematic drawing showing unlocking operation of the indoor lock assembly according to the present invention.
Figure 17:
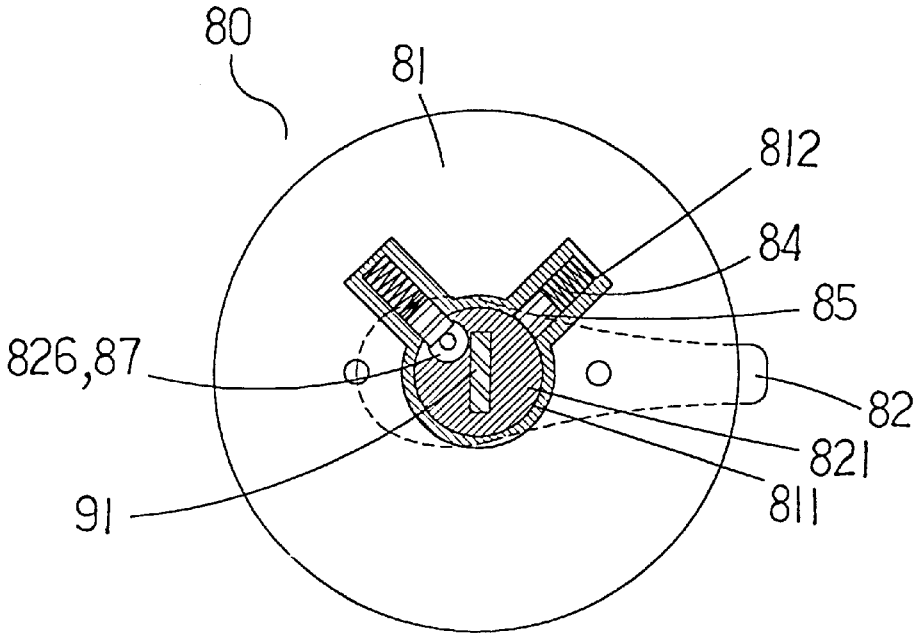
FIG. 17 is a schematic drawing showing the locking operation of the indoor lock assembly according to the present invention.

Referring to FIGS. from 6 through 13, a shell 92 is covered on the lock cylinder 90, and the spindle 91 of the lock cylinder 90 is inserted through the cross hole 71 on the center shaft 72 of the cam 70 and engaged into the rectangular hole 822 on the shaft 821 of the door handle 82. When the key is inserted into the lock cylinder 90 and rotated, the spindle 91 is driven to actuate the rose and door handle assembly 80, the auxiliary door lock 1. When locking, the spring leaf 67 is pressed at the front side edge 75 at the cam 70, causing the pin 73 to move the coupling block 40 and the latch bolt 20 forwards to lock the door, and at the same the latch 84 is engaged into the first neck 872 of the lock pin 87 to stop the door handle 82 from rotation. When the door handle 82 is depressed at this time, the latch 84 is disengaged from the first neck 872 of the lock pin 87 (see FIGS. (9, 10, 11 and 13). When unlocking the lock cylinder 9, the coupling block 40 is driven by the pin 73 of the cam 70 to pull the latch bolt 20 backwards to the unlocking position, and the lock pin 87 is forced backwards by the spring 86, enabling the second neck 873 to be moved with the lock pin 87 to the screw 825, and at this time the latch 84 is aimed at the front end of the lock pin 87 (See FIGS. 12 and 13). At this time, the latch bolt 20 can be locked in the unlocking position. Pressing the button 88 causes the shaft 821 to be stopped from rotary motion (see FIGS. 8, 9 and 11). When the key is removed from the lock cylinder 9 at this time, the latch bolt 20 is still locked in the unlocking position. When the key is removed from the lock cylinder 90 after unlocking, the coupling block 40 is forced forwards by the compression spring 43 to rotate the cam 70, causing the bottom side edge 76 of the cam 70 to be moved to the spring leaf 67, which has a hooked rear end 671 hooked in the notch 531 at the left side board 50, and the latch bolt 20 automatically moves forwards to a distance. At this time, the latch 84 is stopped at the periphery of the lock pin 87 (see FIGS. 13, 14 and 15), therefore the latch bolt 20 automatically moved to the locking position to lock the door when the handle 82 is released from the hand (See FIG. 16). At this time, the button 88 is not operable, and the lock can be unlocked with the key, or by turning the door handle 82. If the door handle 82 is rotated counter-clockwise to the horizontal position, the grooves 812 are aimed at the hole 823, and the latch 84 is forced by the spring 85 into engagement with the first neck 872 at the lock pin 87 (see FIGS. 9 and 17), and therefore the door is locked, and turning the door handle 82 or using the key cannot open the lock. When unlocking the lock at this time, the user must press the button 88 to disengage the first neck 872 of the lock pin 87 from the latch 84 for enabling the door handle 82 to be rotated clockwise to the vertical position (See FIG. 11).

As indicated above, the present invention automatically moves to the locking position after opening of the door and removal of the key.

What the invention claimed is:

1. A door lock comprising a casing, a latch bolt moved in and out of said casing, a left side board and a right side board connected in parallel, a coupling block spaced between said left side board and said right side board, said coupling block having a front end coupled to said latch bolt and a rear end formed with a coupling groove, a cam coupled between said left side board and said right side board, said cam comprising a center shaft, an axially extended cross hole on the center shaft of said cam, and a pin coupled to the coupling groove on said coupling block, an indoor lock assembly, said indoor lock assembly comprising a rose and a door handle, said door handle comprising a shaft and a rectangular hole on the shaft, said rose comprising a center through hole, which receives the shaft of said door handle, and a lock cylinder having a spindle inserted through the cross hole on the center shaft of said cam and engaged into the rectangular hole on the shaft of said door handle, wherein a spring is coupled between a locating rod at said coupling block and a rod at said left side board to push said coupling block and said latch bolt forwards when said lock cylinder is unlocked and the key is removed from said lock cylinder; said rose of said indoor lock assembly comprises two grooves arranged at right angles, and a latch and a spring mounted in the grooves inside said center through hole on said rose; said door handle comprises a spring and a lock pin mounted on the inside and acted relative to said latch to lock/unlock said indoor lock assembly.

* * * * *